US007434587B2

(12) United States Patent
Jeong

(10) Patent No.: US 7,434,587 B2
(45) Date of Patent: Oct. 14, 2008

(54) WATER GUIDE FOR DISHWASHER

(75) Inventor: Mun Gyu Jeong, Busan (KR)

(73) Assignee: LG Electronics Inc., Seoul (KR)

( * ) Notice: Subject to any disclaimer, the term of this patent is extended or adjusted under 35 U.S.C. 154(b) by 402 days.

(21) Appl. No.: 10/968,083

(22) Filed: Oct. 20, 2004

(65) Prior Publication Data

US 2005/0241683 A1 Nov. 3, 2005

(30) Foreign Application Priority Data

May 3, 2004 (KR) ..... 10-2004-0030959

(51) Int. Cl.
*A47L 15/42* (2006.01)

(52) U.S. Cl. ..... 134/58 D

(58) Field of Classification Search ..... 134/58 D
See application file for complete search history.

(56) References Cited

U.S. PATENT DOCUMENTS 2,878,826 A * 3/1959 Dolenga ..... 137/216
3,346,000 A * 10/1967 Cushing ..... 137/216

FOREIGN PATENT DOCUMENTS

DE 10002687 * 7/2001
GB 2090382 A * 7/1982
GB 2216400 A * 3/1989

* cited by examiner

*Primary Examiner*—Michael Barr
*Assistant Examiner*—Jason P Riggleman
(74) *Attorney, Agent, or Firm*—McKenna Long & Aldridge LLP

(57) ABSTRACT

A water guide of a dishwasher checks the flow of water draining from the dishwasher. The water guide includes a drain passage having one end communicating with an outer atmosphere and another end communicating with a sump for receiving washing water, at least part of the drain passage being routed via a point higher than a water level in the sump, and a valve assembly, disposed above the drain passage, for selectively introducing external air into the drain passage.

10 Claims, 3 Drawing Sheets

WATER GUIDE FOR DISHWASHER

This application claims the benefit of Korean Application No. P2004-030959, filed on May 3, 2004, which is hereby incorporated by reference.

BACKGROUND OF THE INVENTION

1. Field of the Invention

The present invention relates to a dishwasher, and more particularly, to a water guide of a dishwasher to check the flow of water drained from the dishwasher.

2. Discussion of the Related Art

A dishwasher is a machine that sprays detergent and washing water on dishes and automatically washes and dries the dishes. The dishwasher typically includes a tub having a door installed at a front side; at least one rack, provided in the tub, for holding dishes; a sump, provided below the tub, for receiving the washing water; at least one sprayer, disposed under the rack, for spraying washing water to the dishes on the rack; and a pump for pumping the washing water in the sump to the sprayer.

As the pump is driven, dishes are washed when the sprayer sprays the dishes with the washing water received in the sump. The washing water sprayed onto the dishes is collected in the sump and is again sprayed onto the dishes. Once the washing operation is completed, a drain pump operates so that the water received in the sump is drained through a drain hose. After the drain pump is stopped, clean water is supplied through a water feed system to the sump for a rinsing operation, and unless the drain hose is installed at a relatively high point on the dishwasher, the clean water is continuously drained owing to siphon phenomenon due to a pressure difference. Accordingly, clean water is wasted. To conserve water, at least part of the drain hose must be disposed at a high point. When the dishwasher as described above is newly installed or relocated, however, a proper installation of the drain hose may be difficult or even impossible.

SUMMARY OF THE INVENTION

Accordingly, the present invention is directed to a water guide of a dishwasher that substantially obviates one or more problems due to limitations and disadvantages of the related art.

An object of the present invention is to provide a water guide of a dishwasher that conserves water by preventing water from being drained when a drainage pump is stopped, though a drainage hose is disposed at a low point.

Another object of the present invention is to provide a water guide of a dishwasher that can prevent washing water remaining in a drainage hose from flowing backward toward a sump when a drainage pump is stopped.

A further object of the present invention is to provide a dishwasher, in which dishwasher installation and relocation are facilitated by enabling a drainage hose to be positioned (or routed) more freely.

Addition advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a water guide for a dishwasher includes a drain passage having one end communicating with an outer atmosphere and another end communicating with a sump for receiving washing water, at least part of the drain passage being routed via a point higher than a water level in the sump, and a valve assembly, disposed above the drain passage, for selectively introducing external air into the drain passage.

The drain passage may be disposed between a drain pump communicating with the sump and a drain hose communicating with the outer atmosphere. And, the valve assembly may be automatically operated by a pressure of water drained through the drain passage.

The valve assembly may include a valve chamber, provided above the drain passage and communicating with the drain passage, the valve chamber communicating with the outer atmosphere via an aperture formed in an upper side of the valve chamber, and a valve body, provided inside the valve chamber, for closing and opening the aperture by ascending and descending inside the valve chamber. The valve body may be made of a material having buoyancy and may include a conic upper end for seating the aperture when the valve body is ascended.

The valve assembly further includes a needle, extending from the valve body through the aperture, for guiding the ascending and descending movement of the valve body inside the valve chamber. And the water guide further includes an air passage, extending from an upper side of the valve chamber, having one end communicating with the outer atmosphere and another end communicating with the aperture.

In another aspect of the present invention, a water guide for a dishwasher includes a drain passage having one end communicating with an outer atmosphere and another end communicating with a sump for receiving washing water, at least part of the drain passage being routed via a point higher than a water level in the sump, a connection passage communicating with the sump and the drain passage, and a check valve, provided at a junction of the drain passage and a connection passage, for selectively opening and closing the connection passage.

The connection passage is closed by the weight of the check valve and is opened by water pressure. The check valve includes a hinged shutter, provided in the connection passage, for opening and closing the connection passage. The connection passage is disposed horizontally and is connected perpendicularly to the drain passage and has a lower portion partially extending into the drain passage. The hinged shutter, when in a closed position, is disposed obliquely to create a self-weighted seal of the drain passage.

In a further aspect of the present invention, a water guide for a dishwasher includes a case, enclosing an inner space, having an air inlet communicating with an outer atmosphere, a drain passage, provided in the case, having one end communicating with the outer atmosphere and another end communicating with a sump for receiving washing water, at least part of the drain passage being routed via a point higher than a water level in the sump, a valve assembly, disposed above the drain passage, for selectively introducing external air into the drain passage via the air inlet, and a feed passage, provided in the case, communicating with the sump and a water feed valve, part of the feed passage being higher than the water level in the sump. Herein, the feed passage communicates with the air inlet.

The case includes a tub opening formed in one side to communicate with a tub of the dishwasher. The water guide may include at least one baffle, provided in the case, such that an air passage between the air inlet and the opening has at least one bend. The at least one baffle includes a first baffle, protruding from an inner surface of the case and disposed obliquely between the air inlet and the opening, and a second baffle, protruding from an outer circumference of the opening and disposed obliquely between the opening and the first baffle.

The water guide may include a flow meter, disposed in the feed passage, for measuring an amount of water flowing through the feed passage, the flow meter having an inlet disposed at a high point, an outlet disposed at a low point, and an impeller disposed between the inlet and the outlet.

The water guide may include a water level sensor, provided in the case, for sensing a full water level in the sump. Herein, the water level sensor includes a tube, provided in the case, such that an inner water level is varied depending on a water level of the sump, a floater provided inside the tube, a lever, supported in the tube and spaced a predetermined interval from the floater, and a switch, disposed on the lever, having a pair of contact terminals that are closed when the lever ascends. The water level sensor may include a partitioning plate, provided in the tube to support the lever, for partitioning an inner space of the tube into an upper space and a lower space, the partitioning plate having a hole for receiving the lever.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

A water guide according to the present invention can be employed in any type of dishwasher supplied with clean water from an external source and then drained. An example of such a dishwasher, employing a water guide according to the present invention, is shown in FIG. 1.

Figure 1:
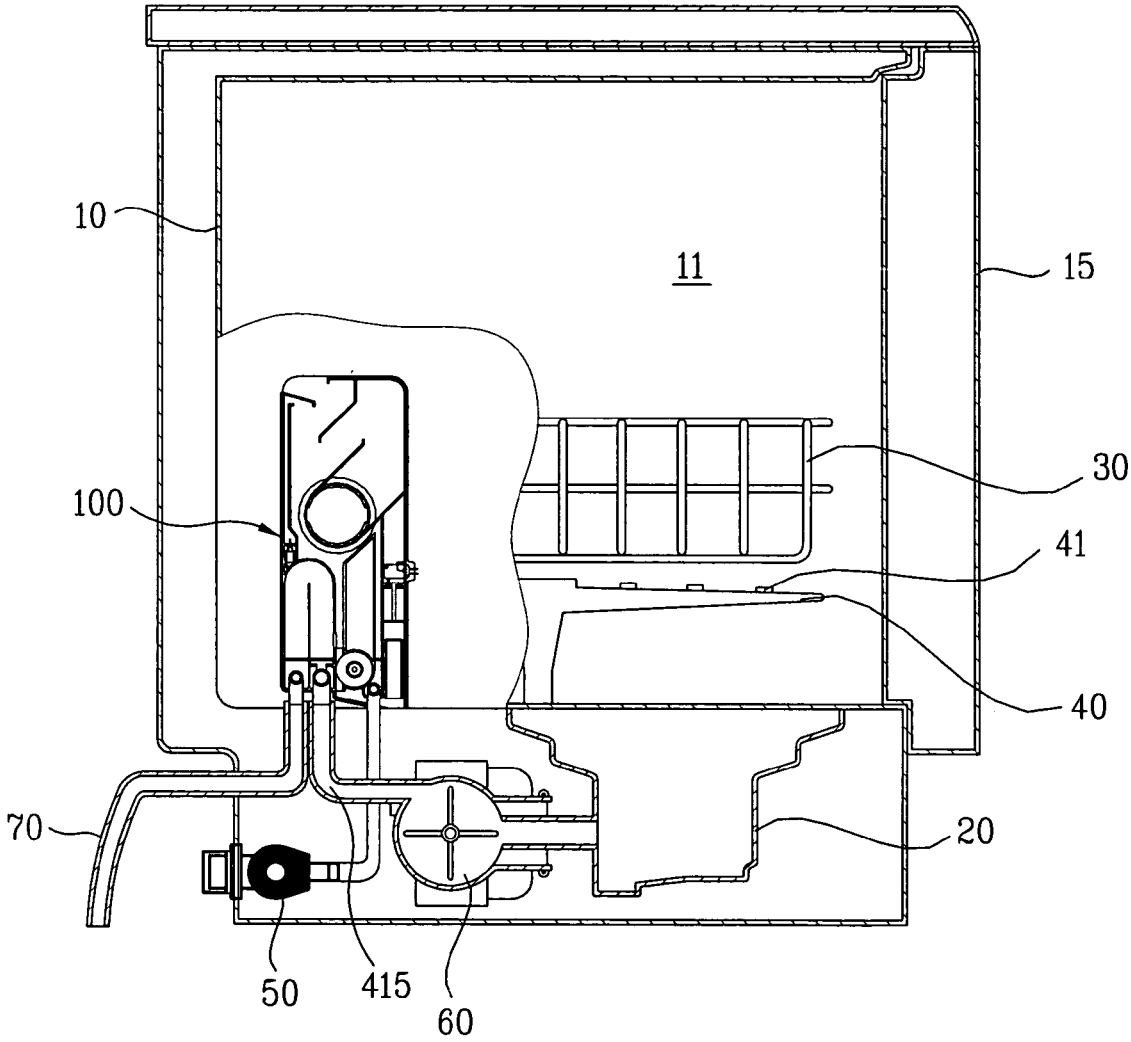
FIG. 1 is a schematic side view of a dishwasher employing a water guide according to the present invention.

Referring to FIG. 1, a washing chamber 11 is provided inside a tub 10. The washing chamber 11 is opened or closed by a door 15 installed at a front side of the tub 10. Inside the washing chamber 11, at least one rack 30 for receiving tableware is provided. The rack 30 can be extracted from the washing chamber 11 when the door 15 is opened. Although FIG. 1 shows an example where one rack is provided, the washing chamber 11 may be provided with two or more racks.

A sump 20 for accommodating washing water is disposed below the washing chamber 11. The sump 20 accommodates clean water supplied from an external source during a water feed operation. For this purpose, a water guide 100 (which is to be described later) is connected to the sump 20 to guide water flow.

In the meantime, the sump 20 also accommodates contaminated washing water, which flows down after being used to wash dishes in the washing chamber 11 during the washing and rinsing operations. For this purpose, a filter (not shown) for filtering and reusing the contaminated washing water is connected to the sump 20.

Also, a pump (not shown) for pumping the washing water received in the sump 20 using a sprayer 40 is connected to the sump 20. The pump includes a motor (not shown) connected to one side of the sump 20, and an impeller (not shown) provided in the sump 20 and axially coupled with the motor. Accordingly, when the motor operates, the impeller rotates to pump the washing water received in the sump 20.

The washing chamber 11 is provided with at least one sprayer 40. The sprayer 40 is supplied with water pumped by the pump and is generally disposed below the rack 30. Since the sprayer 40 is provided with a nozzle 41, the water pumped by the pump (not shown) is sprayed into an interior of the washing chamber 11 through the nozzle 41 of the sprayer 40.

The sprayer 40 is rotatable, and the nozzle 41 sprays the washing water at an inclination. Hence, the sprayer 40 rotates by a reaction force generated when the washing water is sprayed at the inclination of the nozzle 41. The washing water sprayed from the nozzle 41 is uniformly dispersed into the washing chamber 11, so that dishes received in the rack 30 are washed.

Meanwhile, the washing water used for washing and rinsing dishes in the washing chamber 11 is drained. For this operation, a drain pump 60 is connected to the sump 20 and the water guide 100. The water guide 100 guides the flow of contaminated washing water drained from the sump 20, to be expelled from the dishwasher.

As described above, the water guide 100 provided in the dishwasher guides clean water supplied from an external source and guides the contaminated washing water to be drained after washing and rinsing operations. The water guide 100 is attached on an outer surface of the tub 10 and includes a feed passage assembly and a drain passage assembly.

Figure 2:
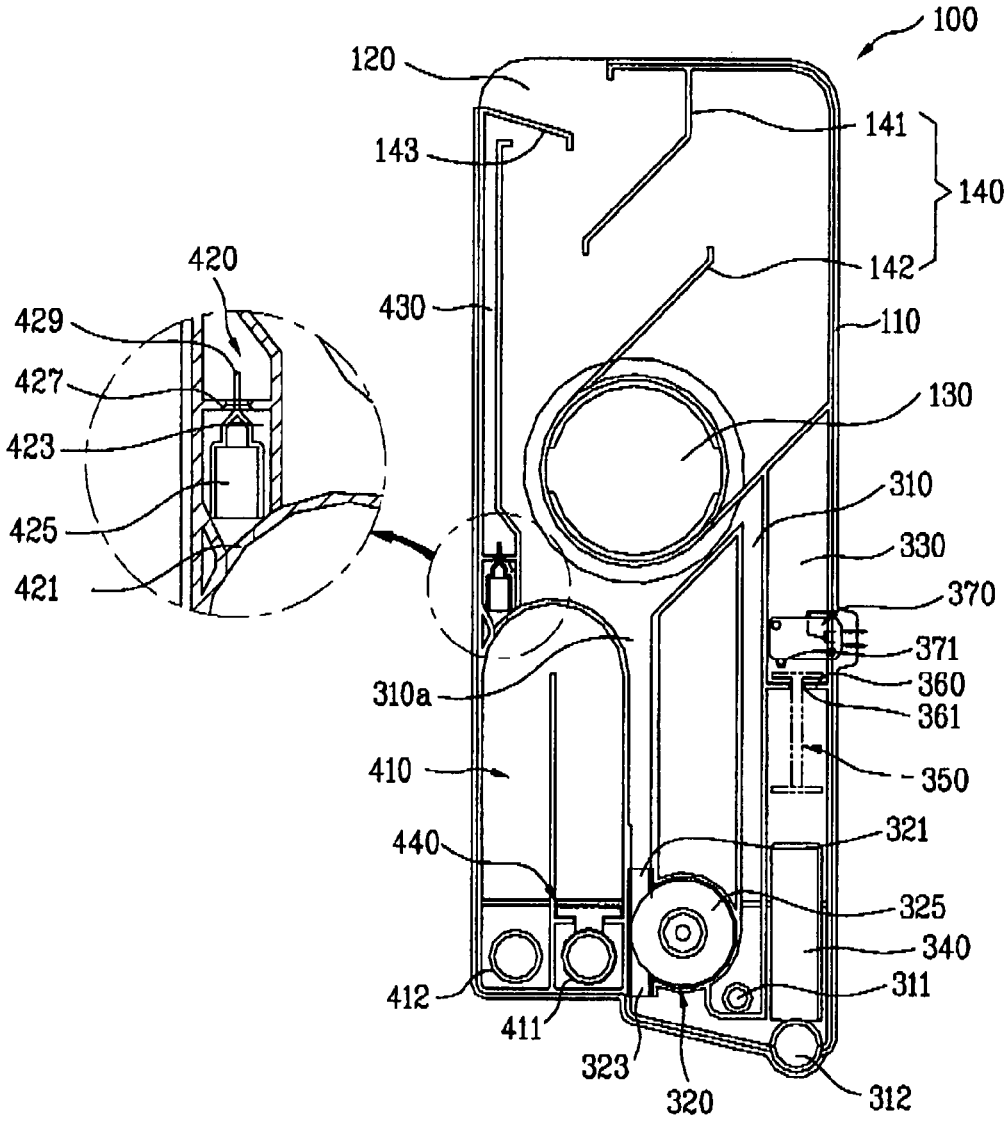
FIG. 2 is a sectional view of the water guide of FIG. 1.
Figure 3:
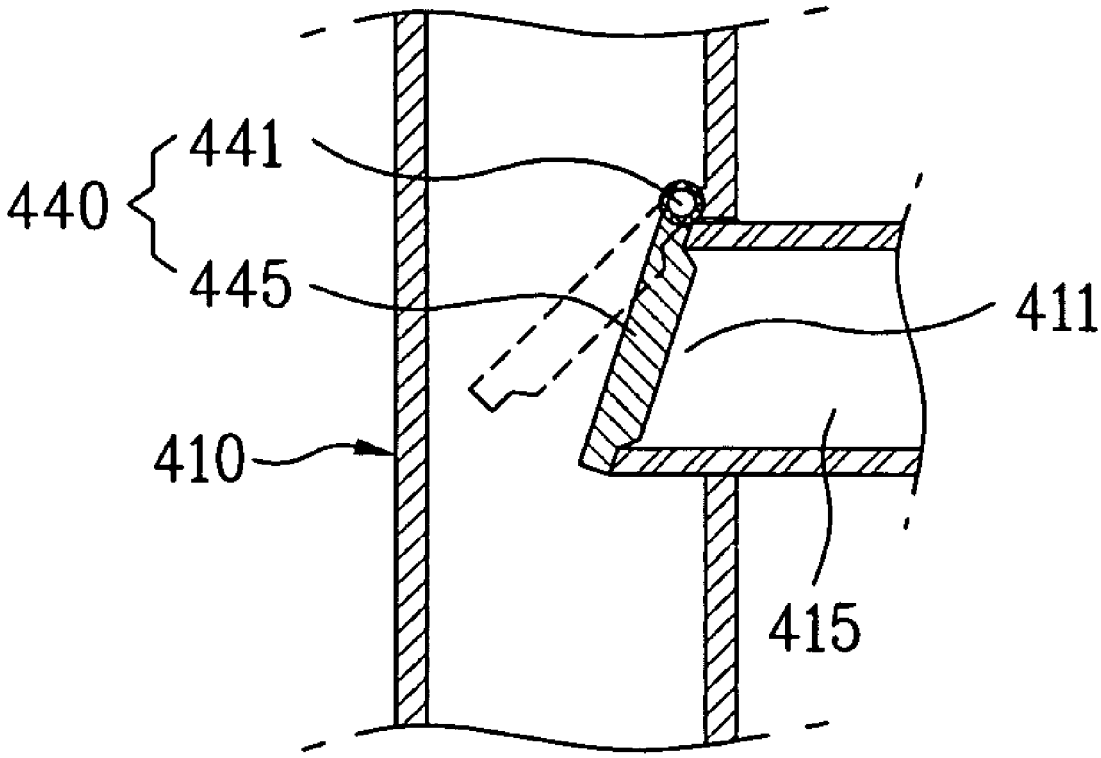
FIG. 3 is a sectional view of a check valve provided in a drain passage of the water guide according to the present invention.

Referring to FIG. 2, the water guide 100 includes a case 110 attached on the tub 10 and enclosing an inner space. The case 110 includes an air inlet 120 communicating with the inner space of the case 110. The air inlet 120 is, for example, disposed at an upper portion of the case 110. A feed passage 310 communicating with the sump 20 and a water feed valve 50 (shown in FIG. 1) is provided inside the inner space of the case 110.

An inlet 311 of the feed passage 310 and an outlet 312 of the feed passage 310 are formed at inner lower portions of the case 110. The inlet 311 of the feed passage 310 communicates with the sump 20. Accordingly, when the water feed valve 50 is opened, clean water is supplied to the sump 20 via the feed passage 310.

In particular, part of the feed passage 310 is disposed at a higher point than the level of the water received in the sump 20. For this purpose, the feed passage 310 has an inverted U-shape in which the inlet 311 and the outlet 312 are disposed at a lower side and an arcing midsection is directed upwards.

The above feed passage 310 can prevent water from being naturally drained (or siphoned) due to a difference in water pressure, even if a drain hose 70 is disposed lower than the level of the water received in the sump 20. Meanwhile, an open upper part of the feed passage 310, communicating with the air inlet 120, is located higher than the level of the water received in the sump 20.

A flow meter 320 is disposed on the feed passage 310 to measure the amount of water supplied to the sump 20 through the feed passage 310. The flow meter 320 is disposed adjacent the outlet 312 of the feed passage 310. The inlet 321 of the flow meter 320 is disposed above the outlet 323 of the flow meter 320, and an impeller 325 rotating under the force of passing water is disposed between the inlet 321 and the outlet 323. Since it is difficult to measure a water pressure of less than 0.5 $Kg/cm^2$ with a flow meter using an impeller, a flow meter having the aforementioned structure is needed, to enable the downward flow of even a small amount of washing water passing through the feed passage 310 to easily rotate the impeller 325. Therefore, in a low-water-pressure environment, the above configuration of the inlet 321, the outlet 323, and the impeller 325 enables the flow rate of water passing through the feed passage 310 to be sensed with precision.

The case 110 includes a tub opening 130 communicating with the tub 10. The tub opening 130 is centrally formed in one side of the case 110 at a point higher than the feed passage 310. When the tub opening 130 is formed as described above, it is possible to maintain the washing chamber 11 inside the tub 10 at an atmospheric state. Hence, siphon phenomenon that may be caused due to a pressure difference between the outer atmosphere and the washing chamber 11 and the sump 20, which are at an equal pressure, can be prevented. Also, though water may overflow from an opened portion 310*a* of the feed passage 310 due to, for example, an abnormal over supply of water, the case 110 does not fill with water since the overflowing water can be redirected to the tub 10.

To prevent an emanation of noise generated inside the tub 10, a baffle 140 is installed in the case 110. The baffle 140 includes at least one baffle such that an air passage between the air inlet 120 and the tub opening 130 has at least one bend. For example, the baffle 140 includes a first baffle 141 protruded from an inner surface of the case 110 and disposed obliquely between the air inlet 120 and the tub opening 130, and a second baffle 142 disposed obliquely from an outer circumference of the tub opening 130 so as to be disposed between the tub opening 130 and the first baffle 141. When the two or more baffles 140 are provided between the tub opening 130 and the air inlet 120, an S-shaped passage is formed between the air inlet 120 and the tub opening 130. Accordingly, the noise in the tub 10 is attenuated while passing through the S-shaped passage.

The water introduced through the feed passage 310 is supplied to the sump 20, so that the water level of the sump 20 rises. When the water level of the sump 20 approaches a full level, the water supply should be stopped. Accordingly, the water guide 100 of the present invention includes a water level sensor for sensing the full level of the water supplied to the sump 20. The water level sensor comprises a tube 330, a floater 340, a lever 350, and a switch 370.

The tube 330 is perpendicular with respect to the outlet 312 of the feed passage 310 communicating with the sump 20. The water level of the tube 330 begins to rise as the water level of the sump 20 approaches a full level. The floater 340 is provided in the tube 330 and ascends or descends depending on the water level of the tube 330. The floater 340 is provided immediately above the outlet 312 of the feed passage 310. Accordingly, a lower portion of the floater 340 is naturally rinsed by water supplied to the sump 20 through the outlet 312 of the feed passage 310. Hence, contaminants do not easily accumulate on the lower side of the floater, to erroneous measurements of the water level of the sump 20 due to a misoperation of the floater 340.

The lever 350 is installed above the floater 340. The lever 350 is supported at a midsection of the tube 330 and is spaced a predetermined distance from an upper end of the floater 340. Accordingly, when the water level of the tube 330 is low, the floater 340 is spaced apart from the lever 350. However, as the water level of the sump 20 approaches a full level and thus the water level of the tube 330 ascends, the floater 340 ascends and nears the lever 350. When the water level of the sump 20 reaches the full level, the floater 340 raises the lever 350.

When the floater 340 is spaced apart from the lever 350 as above, many parts can be exchangeably used regardless of capacities of dishwashers during production of the dishwashers. In other words, by installing floaters 340 having different lengths in dishwashers having different capacities, it becomes possible to easily produce dishwashers having different capacities without changing structures and sizes of other parts.

The switch 370 is installed above the lever 350. The switch 370 has a pair of contact terminals 371 formed at a lower side thereof, which are closed by contact with the lever 350 ascending when the water level of the sump 20 is at a full level.

As described above, when the water level sensor for sensing the full level of the sump 20 is provided and the water level of the sump 20 approaches the full level, the floater 340 and the lever 350 ascend, so that the lever 350 meets the contact terminals 371. By doing so, the water supply to the sump 20 through the feed passage 310 is stopped, or the water of the sump 20 is drained by an operation of the drain pump 60, thereby preventing a malfunction of the dishwasher due to excess water supply and water overflow.

The lever 350 may be supported by a protrusion or the like protruded from an inner wall of the tube 330. In the present invention, a partitioning plate 360 provided in the tube 330 supports the lever 350. Here, the partitioning plate 360 is disposed at a middle portion of the tube 330 to partition the inner space of the tube 330 into an upper space and a lower space. The partitioning plate 360 has a hole 361, and the lever 350 is installed to vertically pass through the hole 361.

Since the lever 350 has a wide upper portion, when the floater 340 is not in contact with the lever 350, the lever 350 is latched by the partitioning plate 360 and supported, and the hole 361 is closed by the wide upper portion of the lever 350. The lever 350 also has a wide lower portion to be stably in contact with the floater 340.

The above structure can effectively prevent a malfunction of the switch 370 due to water vapor that is generated when washing water supplied to the sump 20 is heated by a heater (not shown) provided in the sump 20. The generated vapor is transferred to the switch 370 through the tube 330, so that the switch 370 may be short-circuited. In the present invention, however, since the partitioning plate 360 is provided in the tube 330, the hole 361 of the partitioning plate 360 is closed by the lever 350 while the dishwasher operates normally.

A drain passage 410 communicating with both the sump 20 and the outer atmosphere is provided inside the case 110. The drain passage 410 is disposed at an inner lower side of the case 110, adjacent the feed passage 310, and inlet 411 and outlet 412 of the drain passage 410 are respectively disposed at inner lower portions of the case 110.

The inlet 411 of the drain passage 410 communicates with the drain pump 60 connected with the sump 20, and the outlet 412 of the drain passage 410 is connected with the drain hose 70 communicating with the outer atmosphere. Accordingly, when the drain pump 60 operates, the water received in the sump 20 is drained, in sequence, via the drain pump 60, the drain passage 410 and the drain hose 70 and is then discharged from the dishwasher.

A part of the drain passage 410 is disposed at a point higher than the water level of the sump 20. For this purpose, the drain passage 410 has an inverted U-shape, in which the inlet 411 and the outlet 412 are disposed at a lower side and an arcing midsection is directed upwards, as in the case of the feed passage 310.

The drain passage 410 configured as above can prevent a natural drain phenomenon due to a difference between the water levels of the sump 20 and the drain hose 70. Also, in spite of the drain pump 60 being stopped, a siphon phenomenon, whereby water newly supplied to the sump 20 through the water feed system is continuously drained, can be prevented in cases where the siphon phenomenon is serious. However, the above structure may be insufficient to prevent the siphon phenomenon.

Accordingly, the water guide 100 according to the present invention is provided with a valve assembly 420. The valve assembly 420 can fully resolve the siphon phenomenon by introducing external air supplied through the air inlet 120 into the drain passage 410. The valve assembly 420 is provided above the drain passage 410 and automatically operates by the pressure of water passing through the drain passage 410, to isolate the drain passage 410 from the outside when the pressure of the water drained through the drain passage 410 is high and to introduce external air into the drain passage 410 when the pressure of the water is low, thereby preventing the siphon phenomenon.

The valve assembly 420 includes a valve chamber 423 installed above the drain passage 410 and communicates with the drain passage 410 through a small hole 421 formed at an upper portion of the drain passage 410. An aperture 427 communicating with the inner space of the case 110 is provided at an upper portion of the valve chamber 423. Accordingly, air introduced into the case 110 through the air inlet 120 is supplied to the valve chamber 423 through the aperture 427 and is then supplied to the drain passage 410 through the hole 421.

A valve body 425 is provided inside the valve chamber 423 constructed as above. The valve body 425 is, for example, made of a rubber material capable having buoyancy, and its upper end is conic in shape. The valve body 425 ascends or descends by the pressure of water passing through the drain passage 410, thereby closing or opening the aperture 427.

When the drain pump 60 (shown in FIG. 1) operates, the water of the sump 20 is introduced into the drain passage 410 through the inlet 411. Since the water introduced into the drain passage 410 is pumped by the drain pump 60, the water level first rises rapidly under high pressure and then recedes to be drained via the drain hose 70 through the outlet 412. Some of the water passing through the drain passage 410 is introduced into the valve chamber 423 through the hole 421. Accordingly, the valve body 425 in the valve chamber 423 ascends to close the aperture 427. At this time, the sump 20 does not leak, and the water is drained through the drain passage 410 and the drain hose 70.

Subsequently, when the drain pump 60 is stopped, the pressure, velocity, and amount of water flowing through the drain passage 410 is abruptly reduced. Accordingly, the pressure and level of the water in the valve chamber 423 are lowered, and the buoyancy is weakened, so that the valve body 425 descends. At this time, the aperture 427 is opened, so that the air introduced into the case 110 through the air inlet 120 is rapidly supplied to the drain passage 410. As a result, since the drain passage 410 is converted into an atmospheric state and a pressure difference between the sump 20 and the drain passage 410 is eliminated, the siphon phenomenon disappears. Accordingly, when the drain pump 60 is stopped, drainage is automatically stopped by the valve assembly 420. The valve assembly is, therefore, sometimes referred to as an "air brake".

The valve assembly 420 is provided with a structure for preventing a malfunction of the valve body 425 and for enhancing the reliability of the operation. For this purpose, a long needle 429 extends from a top end of the valve body 425. The needle 429 passes through the aperture 427 to stably guide the vertical (i.e., ascending and descending) movement of the valve body 425.

An air passage 430 for communicating the aperture 427 with the air inlet 120 may be further provided at an upper portion of the valve chamber 423. The air inlet 430 is formed extending upward from an upper portion of the valve chamber 423. The air passage 430 can prevent water from leaking through the aperture 427 during an initial operation of the drain pump 60 or leakage due to a malfunction of the valve body 425. In addition, the water that may leak through the opened upper portion of the feed passage 310 can be prevented from being introduced into the drain passage 410. A third baffle 143 may be provided between the air inlet 120 and the air passage 430 at an upper end of the air passage 430, to reduce the emanation of noise generated in the drain passage 410.

When the drain pump 60 is stopped and air is introduced into the drain passage 410 by the valve assembly 420, some of the water left in the drain passage 410 flows down and may flow backward toward the drain pump 60. Therefore, a check valve 440 for preventing a reverse flow of water is provided on the drain passage 410.

The check valve 440 is provided at the junction of the drain passage 410 and a connection passage 415, which connects the drain pump 60 and the drain passage 410, to open and close the connection passage 415. Accordingly, one end of the connection passage 415 connected with the drain passage 410 may be the inlet 411 of the drain passage 410.

The check valve 440 includes a hinge 441 and a shutter 445. Though the hinge 441 is shown as being fixed to an inner surface of the drain passage 410, the hinge 441 may be fixed to an upper end portion of the connection passage 415. The shutter 445 is provided inside the drain passage 410 so as to be rotatable on the hinge 441. The shutter 445 opens and closes one end of the connection passage 415 connected with the drain passage 410, i.e., the inlet 411 of the drain passage 410, while rotating on the hinge 441.

The connection passage 415 is disposed so as to be substantially horizontal, and the drain passage 410 is joined with the connection passage 415 at an angle, preferably, perpendicular thereto. Accordingly, the check valve 440 is provided at a bend in the water drain passage, i.e., the junction of the drain passage 410 and the connection passage 415, to be closed by its own weight or to be opened by water pressure, so as to stably seal one end of the connection passage 415, i.e., the inlet 411 of the drain passage 410, it is preferable that the shutter 445 is disposed obliquely to create a self-weighted seal of the drain passage. For this purpose, a lower portion of the connection passage 415 partially extends into the drain passage 410 to allow the oblique support of the shutter.

In such a state that the check valve 440 is provided inside the drain passage 410, when the drain pump 60 operates, the shutter 445 is automatically opened by a high pressure of water introduced into the drain passage 410 through the connection passage 415. When the drain pump 60 is stopped and the pressure of water introduced into the drain passage 410 through the connection passage is lowered, the shutter 445 rotates on the hinge 441 under its own weight, thereby closing one end of the connection passage 415. Accordingly, the check valve 440 can effectively prevent the reverse flow phenomenon generated in the drain passage 410 when the drain pump 60 is stopped.

Irrespective of whether the dishwasher operates, external air is introduced through the air inlet 120 into or discharged through the tub opening 130 from the washing chamber 11. Accordingly, the washing chamber 11 maintains the atmospheric state.

When the dishwasher operates, the water feed valve 50 is opened so that clean water is introduced into the feed passage 310 through the inlet 311. The water introduced into the feed passage 310 flows down and passes through the flow meter 320. Accordingly, the flow meter 320 can exactly measure water supply amount. The water having passed through the flow meter 320 is supplied to the sump 20 through the outlet 312. The floater 340 in the tube 330 rises as the water level in the sump 20 rises. The rising floater 340 raises the lever 350, which pushes the contact terminal 371 of the switch 370 when the water level in the sump 20 approaches a full level. As a result, the water feed valve 50 is closed and water supply is stopped. At this time, since the sump 20 is in an atmospheric state and air is introduced into the feed passage 310 through the opened upper portion 310*a*, the siphon phenomenon due to a pressure difference does not occur.

When the water supply is completed, the pump (not shown) connected with the sump 20 operates, so that the water in the sump 20 is pumped to the sprayer 40. The nozzle 41 of the sprayer 40 uniformly sprays the pumped water onto dishes received in the rack 30, thereby washing or rinsing the dishes.

When the washing or rinsing operation of the dishes is completed, the drain pump 60 operates. Then, the water in the sump 20 is drained via the drain pump 60, the connection passage 415, the drain passage 410, and the drain hose 70 and is then discharged. At this time, the check valve 440 is opened, and the valve assembly 420 automatically isolates the drain passage 410 from the outer atmosphere by the water pressure.

When the drain pump 60 is eventually stopped, the valve assembly 420 introduces external air into the drain passage 410 automatically. Accordingly, since the drain passage 410 is also converted into an atmospheric state, the siphon phenomenon due to a pressure difference is prevented. In addition, the check valve is closed so that the water left in the drain passage 410 is prevented from flowing backward toward the drain pump 60 and the sump 20.

According to the present invention, since the valve assembly provided on the drain passage selectively introduces air into the drain passage, excessive water drainage due to the siphon phenomenon can be effectively prevented. Accordingly, it is unnecessary to route the drain hose via a high point. The feed passage can also contribute to the prevention of the siphon phenomenon.

The check valve provided on the drain passage prevents a reverse flow of water that may occur when the drain pump is stopped. Particularly, since the shutter of the check valve is disposed obliquely, the drain passage can be sealed by the weight of the shutter. Since the floater, the lever, and the switch sense a full level of water exactly and the flow meter is installed such that it can exactly measure the water supply amount, the reliability of the dishwasher is enhanced.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A water guide for an appliance, comprising:

a case fixed to the appliance, the case enclosing an inner space, having an air inlet communicating with an atmosphere external to the case;

a drain passage, provided in the case, having one end communicating with the external atmosphere and another end communicating with a sump for receiving washing water, at least part of the drain passage being routed via a point higher than a water level in the sump;

a valve assembly, disposed above the drain passage, for selectively introducing external air into the drain passage via the air inlet;

a feed passage, provided in the case, communicating with the sump and a water feed valve, part of the feed passage being higher than the water level in the sump wherein the drain passage is positioned within the appliance such that the entire drain passage is elevated higher than a highest elevation of the drain hose; and a water level sensor, provided in the case, for sensing a full water level in the sump.

2. The water guide of claim 1, wherein the valve assembly comprises:

a valve chamber, provided above the drain passage and communicating with the drain passage, the valve chamber communicating with the external atmosphere via an aperture formed in an upper side of the valve chamber; and a valve body, provided inside the valve chamber, for closing and opening the aperture by ascending and descending inside the valve chamber.

3. The water guide of claim 2, wherein the valve assembly further comprises a needle, extending from the valve body through the aperture, for guiding the ascending and descending movement of the valve body inside the valve chamber.

4. The water guide of claim 1, further comprising:

a check valve for preventing a reverse flow of water drained through the drain passage; and a hinged shutter, provided in the drain passage, for opening and closing the drain passage.

5. The water guide of claim 4, wherein the hinged shutter, when in a closed position, is disposed obliquely to create a self-weighted seal of the drain passage.

6. The water guide of claim 1, wherein the feed passage communicates with the air inlet.

7. The water guide of claim 1, wherein the case has a tub opening formed in one side to communicate with a tub of the appliance, wherein the appliance is a dishwasher.

8. The water guide of claim 1, further comprising a flow meter, disposed in the feed passage, for measuring an amount of water flowing through the feed passage, the flow meter having an inlet disposed at a high point, an outlet disposed at a low point, and an impeller disposed between the inlet and the outlet.

9. The water guide of claim 1, wherein the water level sensor comprises:

a tube, provided in the case, such that an inner water level is varied depending on a water level of the sump;

a floater provided inside the tube; a lever, supported in the tube and spaced a predetermined interval from the floater; and a switch, disposed on the lever, having a pair of contact terminals that are closed when the lever ascends.

10. The water guide of claim 9, wherein the water level sensor further comprises a partitioning plate, provided in the tube to support the lever, for partitioning an inner space of the tube into an upper space and a lower space, the partitioning plate having a hole for receiving the lever.

* * * * *